United States Patent [19]

Malavazos et al.

[11] Patent Number: 4,744,566

[45] Date of Patent: May 17, 1988

[54] COIN PROJECTING, MOVING TARGET GAME APPARATUS

[76] Inventors: Gregory A. Malavazos; Alex J. Malavazos, both of Rte. 1, 1125 Amarillo Dr., Gardnerville, Nev. 89410

[21] Appl. No.: 926,325

[22] Filed: Nov. 3, 1986

[51] Int. Cl.[4] ..... A63F 9/02

[52] U.S. Cl. ..... 273/357; 273/138 A; 273/368; 273/399

[58] Field of Search ..... 273/355, 356, 357, 399, 273/405, 368, 138 A

[56] References Cited

U.S. PATENT DOCUMENTS

| | | | |
|---|---|---|---|
| 2,734,745 | 2/1956 | Tarte | 273/368 X |
| 4,496,160 | 1/1985 | Wichinsky et al. | 273/399 X |
| 4,614,342 | 9/1986 | Takashima | 273/138 A X |

*Primary Examiner*—Anton O. Oechsle

*Attorney, Agent, or Firm*—Harris Zimmerman; Howard Cohen

[57] ABSTRACT

A coin projecting game apparatus includes a transparent display housing having a rotating target carousel disposed therein. A plurality of player positions are spaced about the display housing, with non-player areas interposed therebetween. Each player position includes a coin projecting device which shoots a coin provided by the player toward the target carousel. The target carousel includes a plurality of annular shelves of decreasing diameter with increasing height, and upwardly extending target panels in regular polygon array separating adjacent shelves, the target panels rotating as a unit. Each target panel is provided with at least one jackpot opening dimensioned to receive a coin projected thereat. Within the carousel, a plurality of annular coin diverter slots are disposed in non-rotating fashion in confronting relation to each player position. Any coin projected through a jackpot opening is directed into a respective diverter slot, and then to a sensor which issues a payoff to the player commensurate with the amount labeled on the opening. In the non-player areas a coin elevator showers coins onto the shelves to attract new players. Each coin projecting device includes a variable angle coin deflector driven by cam action to randomly vary the angle of projection of the coin toward the target.

18 Claims, 3 Drawing Sheets

COIN PROJECTING, MOVING TARGET GAME APPARATUS

BACKGROUND OF THE INVENTION

There is known in the prior art a large number of devices adapted for games of chance. The most ubiquitous example is the slot machine, in which an inserted coin permits the player to rotate a plurality of game wheels in the hope of attaining a desirable orientation of the wheel which will provide a payoff greater than the coin input. These machines provide, in addition to the opportunity to win, the attributes of motion, sound, and color (the indicia provided on the wheels are usually vividly colored). However, these attributes are present only during the use of the machine; when idle, a slot machine provides no audible or visual attraction to invite a passerby to become a potential player.

Another similar form of game machine involves the use of coins or tokens provided by the player as an integral part of the game played therewith. The coin is projected or translated by the player toward a target arrangement, the target including areas or openings which constitute winning, or payoff areas. Such games generally provide more of a sense of participation in the game, with the player directing to some extend the play and the outcome of the game. Although the outcomes of such games may in fact be completely random, the interjection of player participation is more satisfying to many individuals. Also, the ability to visualize the money involved in the game and the possible payoff is inherently enticing. However, these games generally share one similarity with the slot machine; when not in use, there is no audible or moving visual stimulus projected by the game machine to attract a potential player.

Furthermore, these game machines are usually constructed for the use of one individual at a time, which certainly suits the desires of a significant segment of the gambling public. However, many individuals prefer to gamble within a group of people, as is found in card games, roulette, and the like. Such group-oriented individuals are generally overlooked by the gaming machine business, which does not design machines for use by a plurality of persons at one time.

SUMMARY OF THE PRESENT INVENTION

The present invention generally comprises a game machine which employs coins or tokens inserted by the player as the game-playing element. A salient feature of the invention is that it permits several persons to play the game at the same time, using a common game target assembly, with each player receiving a payoff in accord with the results of that player's game. Furthermore, the game mechanism provides continuous motion, sound, and visual interest to attract passerby to play the game.

The game apparatus includes a transparent display housing having a rotating target carousel disposed therein. A plurality of player positions are spaced about the display housing, with non-player areas interposed therebetween, each player position being directed to a differing peripheral portion of the common target carousel. The target carousel includes a plurality of annular shelves of decreasing diameter with increasing height, and upwardly extending target panels in regular polygon array separating adjacent shelves, the target panels rotating as a unit while the shelves remain stationary. Each target panel is provided with at least one jackpot opening dimensioned to receive a coin projected thereat.

Within the carousel, a plurality of annular segment coin diverter slots are secured in non-rotating fashion, each annular segment subtending an angle slightly greater than the angle subtended by one player position. Any coin projected through a jackpot opening by a player is directed into a respective diverter slot, and thence to a sensor which issues a payoff to the player commensurate with the amount labeled on the opening. The non-player areas are divided from the player areas by transparent separator panels extending radially between the target carousel and the display housing. Within the non-player areas a coin elevator showers coins onto the shelves. As the coins cascade down the shelves, they produce a visual and audible display which attract new players. The rotating target panels strike the coins which fall to rest on the shelves, knocking them down to a lower shelf.

Each player position includes a coin projecting device which shoots a coin provided by the player toward the target carousel. The coin projecting device includes a coin verifier, and a spinning friction wheel which propels the coin along a track. At the outlet end of the track, a variable angle coin deflector is driven by cam action to randomly vary the angle of projection of the coin toward the target. Coins which miss the jackpot openings eventually fall from the shelves and are collected in a bin at the bottom of the display housing.

DESCRIPTION OF THE PREFERRED EMBODIMENT

Figure 1:
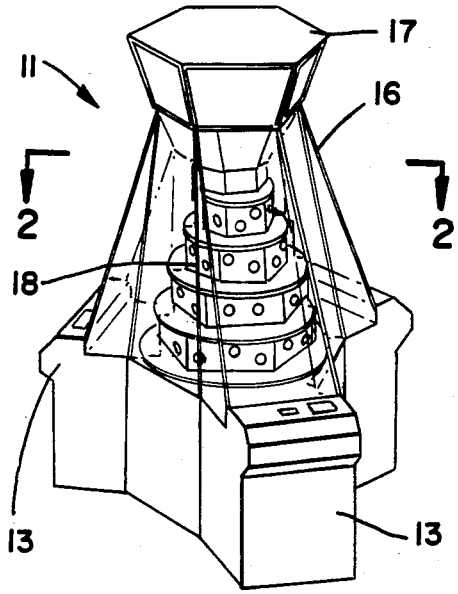
FIG. 1 is a perspective of the coin projecting, rotating target, multiple player game machine of the present invention.
Figure 2:
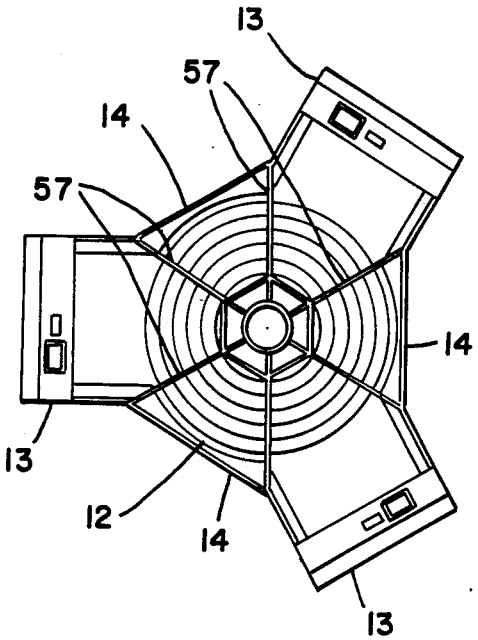
FIG. 2 is a cross-sectional top view of the game machine of the present invention, taken along line 2—2 of FIG. 1.

The present invention generally comprises a coin projecting game machine in which a plurality of players each shoot coins at a common, moving target assembly. As shown in FIGS. 1 and 2, the preferred embodiment of the game machine includes a generally hexagonal base assembly 12, and a trio of player consoles 13 extending outwardly from equally spaced sides of the base assembly. Each console 13 is dimensioned so that a player may stand or sit adjacent thereto and operate the game machine described below. Disposed between the consoles 13 are a plurality of non-player areas 14.

A salient feature of the invention is the provision of a display housing 16 supported atop the base assembly and player consoles. The display housing comprises a plurality of transparent panels of tempered glass or high impact plastic material, the panels extending from the base and player consoles upwardly in a tapering configuration to a crown 17. The crown 17 is a tapered hexagonal prism formed of opaque panels which may bear advertising indicia for the game, or the like. The display housing provides a completely enclosed central chamber which is completely visible from any angle about the apparatus.

Figure 3:
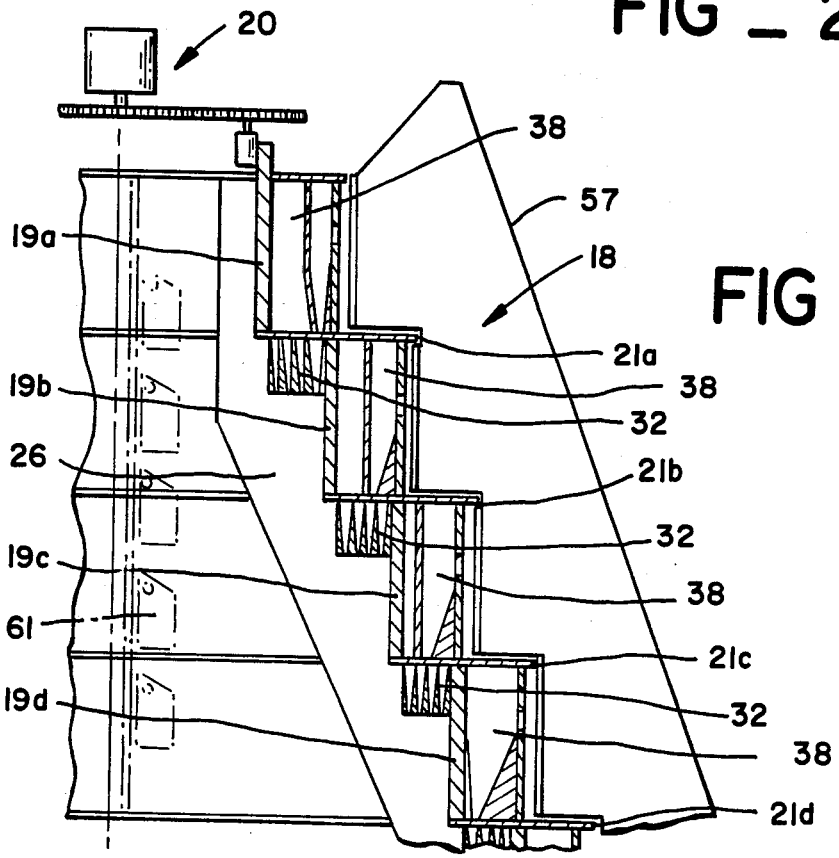
FIG. 3 is an enlarged, cross-sectional detail elevation of the target carousel assembly of the present invention.

Another significant feature of the invention is the provision of a target carousel assembly 18, as shown in FIGS. 1–3, disposed within the chamber defined by the display housing 17. Generally speaking, the target carousel assembly is disposed to rotate continuously within the chamber, while players situated at the player consoles shoot coins at the target carousel. The carousel is comprised of a plurality of cylindrical walls 19*a*–19*d* disposed in concentric, stacked alignment, the cylinders decreasing in diameter with increasing levels in the stacked arrangement.

Figure 4:
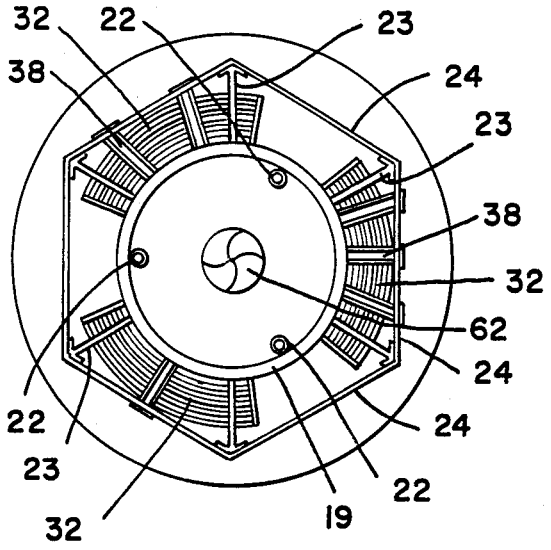
FIG. 4 is a cross-sectional top view of the target carousel assembly of the present invention, showing the coin diverter and distribution arrangement.

With regard to FIG. 4, each cylindrical wall (indicated generically at 19) is centered by a plurality of roller guides 22 and supported for rotation about the common axis. Extending outwardly from each wall 19 are six arms 23, spaced at equal angles thereabout. Six planar target panels 24 are secured between the arms 23, defining an outer hexagon configuration which rotates with the wall 19. A motor drive assembly 20, shown schematically in FIG. 3, is coupled to each of the cylindrical walls 19*a*–19*d* to drive the cylindrical walls in continuous rotational motion. In the preferred embodiment, the motor drive assembly 20 is connected to one of the roller guides 22 of each cylindrical wall 19*a*–19*d* for rotational drive purposes.

The carousel assembly also includes a plurality of stepped internal supports 26 which are fixedly arrayed about the rotational axis of the walls 19. A plurality of annular shelves 21*a*–21*d* are secured rigidly to the supports 26 and disposed between vertically adjacent walls 19. The shelves are also provided with decreasing inner and outer diameters with increasing height, in proportion to the walls 19, to interfit therewith. That is, the inner diameter of each annular shelf member 21 is substantially the same as the superjacent wall 19, and the outer diameter of each shelf is greater than the subjacent wall 19. The target panels 24 are thus disposed to sweep across a substantial portion of the surface area of the annular shelf member disposed directly below the respective target panel assembly.

Figure 5:
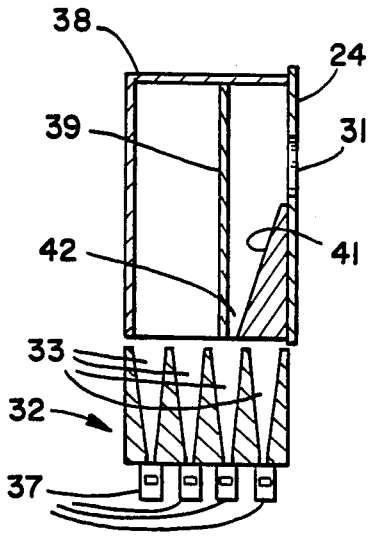
FIG. 5 is an enlarged cross-sectional detail view of a coin diverter assembly of the present invention.
Figure 6:
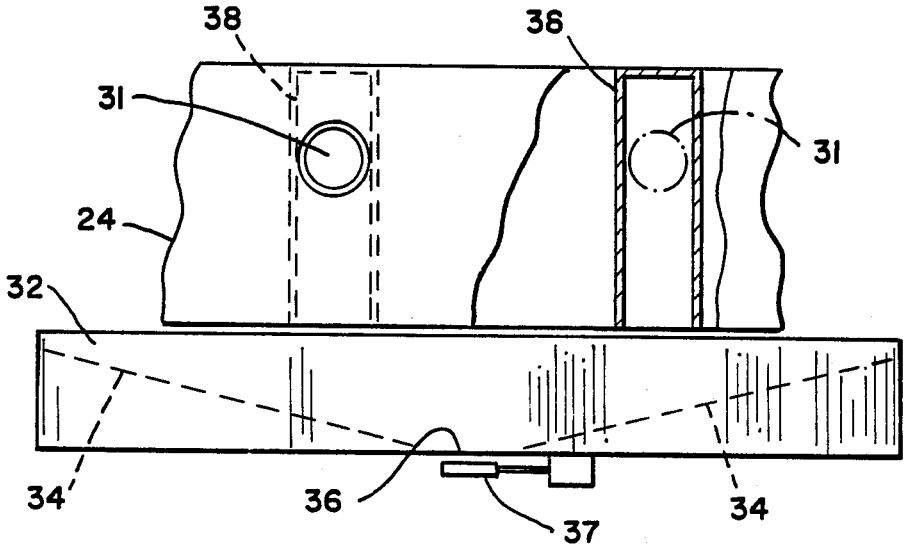
FIG. 6 is an magnified, partially cutaway elevation of the coin payoff sensing arrangement of the present invention.

It may be appreciated that each of the target panels is provided with at least one, and generally more than one, winner opening 31, as shown in FIG. 6. Each winner opening is labeled with indicia to show the payoff received by the player for projecting a coin into the particular opening. To perform this function, the invention is provided with a coin win registration system. This system includes a plurality of coin receivers 32, each disposed adjacent to one of the player consoles and subtending an angle slightly greater than the player console. As shown in FIGS. 3–6, the coin receivers are secured fixedly to the internal supports 26. Each of the coin receivers is provided with a plurality of annular coin channels 33 (FIG. 5), each channel having a sloping bottom 34 which leads to an outlet 36. A sensor 37 is positioned at the outlet 36 of each coin channel 33 to detect the passage of a coin through the outlet.

Each channel 33 is representative of a predetermined payoff amount awarded to the player, corresponding to the indicia adjacent to each winner opening 31. To transfer a coin which is projected through a winner opening to the corresponding coin channel 33, the invention includes a plurality of diverter boxes 38, each secured to the inner surface of a target panel 24 and disposed to receive any coin projected through one opening 31, as shown in FIGS. 5 and 6. Each diverter box 38 includes a closed top and sides, and an open bottom. An internal panel 39 and a baffle 41 within the box 38 define a coin drop slot 42 which is disposed in registration with the channel 33 corresponding to the payoff amount appropriate for the winner opening to which the box 38 is secured. It may be appreciated that the drop slot 42 remains in registration with the same slot throughout the traversal of the player position, due to the circular configuration of the channels 33.

When a sensor 37 is actuated, the appropriate payoff is issued to the player at the console 13, either in the form of a plurality of coins, or by signaling an attendant to deliver the winning sum.

Figure 7:
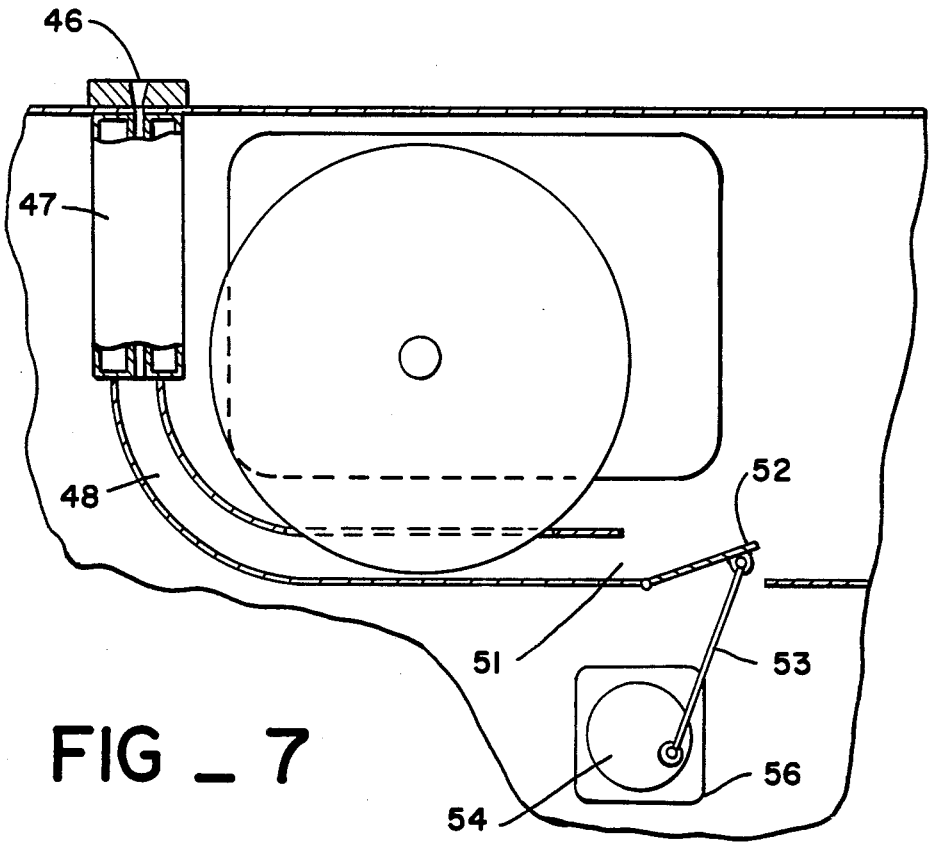
FIG. 7 is an enlarged, detailed cross-sectional elevation of the coin projecting mechanism of the present invention.
Figure 8:
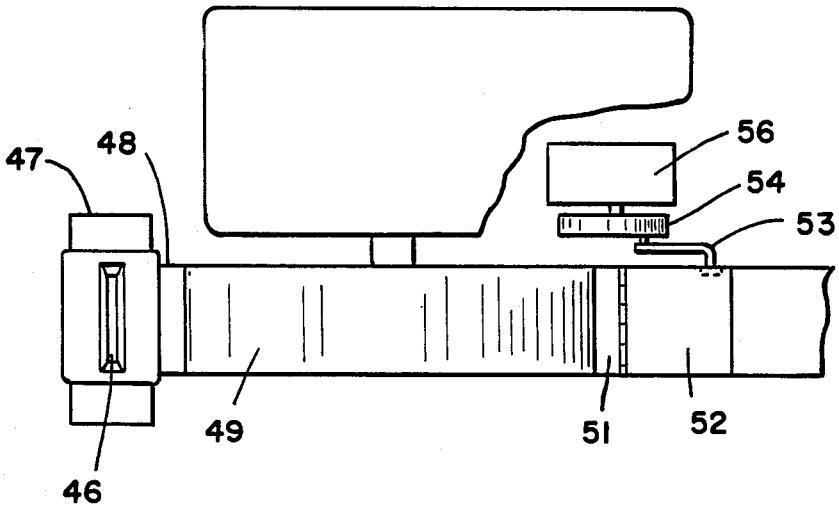
FIG. 8 is a magnified top view of the coin projecting mechanism as shown in FIG. 7.

Another salient feature of the present invention is the provision of a novel coin projecting apparatus, as shown in FIGS. 7 and 8, for shooting coins at the target assembly. The apparatus includes an coin input slot 46 which leads directly to a coin verifier 47. The device 47, well known in the prior art, determines that the coin is authentic, and then drops the coin into a channel-like track 48. (If the coin fails verification, it is directed to a rejected coin outlet slot, not shown.) An impeller wheel 49 extends into the track 48, and is driven at constant high speed. The constant diameter wheel 49 is fabricated of resilient material, and provides sufficient clearance for a coin to pass in interference fit with the wheel. The spinning wheel imparts high velocity to the coin, which then exits the outlet port 51 of the track 48.

Disposed at the exit outlet 51 is a coin deflector 52, which is hinged to one portion of the track 48 to rotate in a vertical plane. The free end of the deflector 52 is joined by a link arm 53 to an eccentric cam 54. The cam 54 is driven at constant speed by a motor 56, so that the deflector undergoes continual variation in angle in the vertical plane. As a result, any coin existing the outlet 51 is deflected by a random amount in its vertical trajectory, although the horizontal component of the trajectory is unaffected. Thus a game player cannot control the vertical angle at which a played coin is projected toward the target carousel, although some playing skill is involved in directing the coin at a chosen vertical swath of the carousel.

It should be noted that the coins which miss the winner openings and fall onto the shelves 21 will accumulate there, providing an obvious visual indication of the potential payoff of the game. Also, the coins tend to be gradually driven from each shelf by the sweeping action of the rotating target panels, as explained previously. Thus the visual attraction of the game is heightened by the audible clinking and ringing of falling coins. To augment these effects, the interior chamber of the display housing is provided with separator panels 57 extending radially inwardly from the housing 16 to the target carousel 18, as shown in FIGS. 1–3. The panels extend from each player console toward the carousel to divide the player areas of the chamber from the non-player areas 14.

A coin elevator mechanism is provided to raise coins from the bottom of the chamber to the upper shelf of the target carousel, from which the coins fall in cascades in the non-player areas. As shown in FIG. 3, the coin elevator may comprise a multiple bucket mechanism 61, well known in the prior art, in which a plurality of buckets are secured to an endless loop drive belt or chain. The buckets pick up coins in the house win bin at the bottom of the game apparatus, and deposit them at the top of the target carousel, where a diverter directs the coins to cascade down the non-player areas. Alternatively, as shown in FIG. 4, the elevator may comprise a rotating auger 62, also well known in the prior art.

The coin cascade provides a highly augmented visual and audible effect to attract new players to the game. It may be appreciated that the separator panels 57 prevent the cascading coins from falling or bouncing into the winner openings of the target panels when they are disposed within the player areas, where an unearned payoff might otherwise result.

It should be noted that the amount payed in jackpot awards can be selectively controlled by the operator of the game, by varying the following factors: the number of winner openings, the diameter and placement of the winner openings, the amount payed for each winner opening, the rotation rate of the target panels, the alignment of the coin projecting device, and the cam action of the coin deflector 52.

It should be emphasized that all player consoles can be used simultaneously, or singly, depending upon the number of players desiring to play the game at any one time. Thus one target mechanism serves several players, although each player receives a payoff based only on the play within his or her specific player area. As an added attraction, the individual cylindrical walls 19 may be driven by the motor assembly in counterrotating fashion with respect to vertically adjacent walls 19, thus increasing the apparent motion of the target carousel.

We claim:

1. A coin projecting game apparatus, including; a transparent display housing, a central target carousel disposed within said display housing, a plurality of player consoles spaced about the display housing, a plurality of coin projecting means, each disposed at one of said player consoles, for projecting a coin provided by the player toward said target carousel, said target carousel including a plurality of upwardly extending target panels, a plurality of winner openings disposed in said target panels and dimensioned to receive a coin projected from said coin projecting means, and means for issuing an award at each player console in response to a coin projected therefrom being received in one of said winner openings, means for rotating said target panels about an axis, said axis being spaced generally equally from said plurality of player consoles, said target panels being disposed in end-to-end alignment in a plurality of closed polygons, said polygons rotating concentrically about said axis.

2. The coin projecting apparatus of claim 1, wherein said polygons are disposed in vertically stacked arrangement concentrically with said axis, said polygons having decreasing width with increasing height in said stacked arrangement.

3. The coin projecting game apparatus of claim 2, further including a plurality of annular shelf members, said shelf members including horizontally disposed surfaces extending between vertically adjacent polygons in said stacked arrangement.

4. The coin projecting game apparatus of claim 3, further including a plurality of coin diverter boxes disposed within said polygons, each of said coin diverter boxes secured to one of said target panels for rotation in common therewith and disposed to receive coins projected through one of said winner openings.

5. The coin projecting game apparatus of claim 4, further including coin receiving means secured in stationary fashion subjacent to said rotating polygons of target panels, said coin diverter boxes including drop slots therein disposed to deposit any coin received in said diverter boxes into said coin receiving means.

6. The coin projecting game apparatus of claim 5, wherein said coin receiving means includes a plurality of annular coin receivers, each disposed adjacent to one of said player consoles and subtending an angle about said axis substantially equal to the angle subtended by the respective player console.

7. The coin projecting game apparatus of claim 6, wherein said annular coin receivers include a plurality of coin channels disposed therein and oriented to receive coins from said drop slots of said coin diverter boxes, said coin channels extending arcuately in constant radius fashion with respect to said axis.

8. The coin projecting game apparatus of claim 7, wherein said coin channels each include sloping bottom surfaces inclined toward an outlet opening, and sensor means for detecting the passage of a coin through said outlet opening, said sensor means being connected in actuating relationship to said means for issuing an award.

9. The coin projecting game apparatus of claim 8, wherein each of said coin channels is provided with a separate sensor means, each separate sensor means connected to issue an award of preselected, differing value.

10. A coin projecting game apparatus, including; a transparent display housing, a central target carousel disposed within said display housing, a plurality of player consoles spaced about the display housing, a plurality of coin projecting means, each disposed at one of said player consoles, for projecting a coin provided by the player toward said target carousel, said target carousel including a plurality of upwardly extending target panels, a plurality of winner openings disposed in said target panels and dimensioned to receive a coin projected from said coin projecting means, and means for issuing an award at each player console in response to a coin projected therefrom being received in one of said winner openings, said display housing comprising a transparent housing completely enclosing said central target carousel, said player consoles disposed to be interspersed with non-player areas spaced about said display housing, a plurality of separator panels extending from each player console toward said central target carousel, said separator panels disposed to divide said non-player areas from player areas adjacent to each player console, and coin cascade means for showering coins onto the upper portions of said target carousel within said non-player areas.

11. A coin projecting game apparatus, including; a transparent display housing, a central target carousel disposed within said display housing, a plurality of player consoles spaced about the display housing, a plurality of coin projecting means, each disposed at one of said player consoles, for projecting a coin provided by the player toward said target carousel, said target carousel including a plurality of upwardly extending target panels, a plurality of winner openings disposed in said target panels and dimensioned to receive a coin projected from said coin projecting means, and means for issuing an award at each player console in response to a coin projected therefrom being received in one of said winner openings, said plurality of coin projecting means including a plurality of coin projectors, each having an outlet opening directed toward said target carousel, a plurality of movable coin deflectors, each disposed adjacent to one of said outlet openings of said coin projectors, and means for driving each of said coin deflectors in oscillating fashion to deflect a coin from the respective coin projector in random fashion.

12. A coin projecting game apparatus, including; a transparent display housing, a central target carousel disposed within said display housing, a plurality of player consoles spaced about the display housing, a plurality of coin projecting means, each disposed at one of said player consoles, for projecting a coin provided by the player toward said target carousel, said target carousel including a plurality of upwardly extending target panels, means for rotating said target panels continuously past said player consoles, a plurality of winner openings disposed in said target panels and dimensioned to rèceive a coin projected from said coin projecting means, means for issuing an award at each player console in response to a coin projected therefrom being received in one of said winner openings, and means for separating said transparent display housing into a plurality of discrete game areas, each associated with one of said player consoles and a portion of said target carousel, said means for separating also preventing any coins emitted by the coin projecting means of the respective player console from being projected outside the respective discrete game area.

13. A coin projecting game apparatus, including; a transparent display housing, a central target carousel disposed within said display housing, a plurality of player consoles spaced about the display housing and directed toward a respective portion of said central target carousel, a plurality of coin projecting means, each disposed at one of said player consoles, for projecting a coin provided by the player toward said respective portion of said target carousel, said target carousel including a plurality of upwardly extending target panels, means for rotating said target panels continuously past said player consoles, a plurality of winner openings disposed in said target panels and dimensioned to receive a coin projected from said coin projecting means, means for issuing an award at each player console in response to a coin projected therefrom being received in one of said winner openings, means for preventing any coins emitted by the coin projecting means of the respective player console from being projected toward the respective target carousel portion of another player console, said means for preventing also including means for permitting said target panels to rotate thereby.

14. The coin projecting game apparatus of claim 13, wherein said display housing comprises a transparent housing completely enclosing said central target carousel.

15. The coin projecting game apparatus of claim 14, wherein said player consoles are interspersed with non-player areas spaced about said display housing.

16. The coin projecting game apparatus of claim 15, wherein said means for preventing coins from being projected toward the target carousel portion of another player console includes a plurality of separator panels extending from each player console toward said central target carousel, said separator panels disposed to divide said non-player areas from player areas adjacent to each player console.

17. A coin projecting game apparatus, including; a transparent display housing, a central target carousel disposed within said display housing, a plurality of player consoles spaced about the display housing, a plurality of coin projecting means, each disposed at one of said player consoles, for projecting a coin provided by the player toward said target carousel, said target carousel including a plurality of upwardly extending target panels, means for moving said target panels continuously past said player consoles in opposed, coin receiving relationship to said coin projecting means, a plurality of annular shelf members, said shelf members including horizontally disposed surfaces extending at the lower end portions of said target panels and adapted to retain a plurality of coins thereon, said target panels further disposed to push coins from said horizontally disposed surfaces as said target panels move, a plurality of winner openings disposed in said target panels and dimensioned to receive a coin projected from said coin projecting means, and means for issuing an award at each player console in response to a coin projected therefrom being received in one of said winner openings.

18. A coin projecting game apparatus, including; a transparent display housing, a central target carousel disposed within said display housing, a plurality of player consoles spaced about the display housing, a plurality of coin projecting means, each disposed at one of said player consoles, for projecting a coin provided by the player toward said target carousel, said target carousel including a plurality of upwardly extending target panels, a plurality of winner openings disposed in said target panels and dimensioned to receive a coin projected from said coin projecting means, and means for issuing an award at each player console in response to a coin projected therefrom being received in one of said winner openings, said plurality of coin projecting means including a plurality of coin projectors, each having an outlet opening directed toward said target carousel, a plurality of movable coin deflectors, each disposed adjacent to one of said outlet openings of said coin projectors, and means for driving each of said coin deflectors through controlled angular excursions to deflect coins from the respective coin projector in a predetermined pattern through a preselected angular range.

* * * * *